US010914126B2

(12) United States Patent
Pickelsimer

(10) Patent No.: US 10,914,126 B2
(45) Date of Patent: Feb. 9, 2021

(54) DRILL STRING TESTING SYSTEM

(71) Applicant: Allegiant Energy Services, LLC, Oklahoma City, OK (US)

(72) Inventor: Danny Pickelsimer, Yukon, OK (US)

(73) Assignee: Allegiant Energy Services, LLC, Oklahoma City, OK (US)

( * ) Notice: Subject to any disclaimer, the term of this patent is extended or adjusted under 35 U.S.C. 154(b) by 309 days.

(21) Appl. No.: 16/008,799

(22) Filed: Jun. 14, 2018

(65) Prior Publication Data

US 2019/0383104 A1 Dec. 19, 2019

(51) Int. Cl.

| | |
|---|---|
| ***E21B 15/00*** | (2006.01) |
| ***E21B 17/04*** | (2006.01) |
| ***E21B 33/06*** | (2006.01) |
| ***E21B 47/06*** | (2012.01) |
| ***E21B 47/00*** | (2012.01) |
| ***E21B 47/008*** | (2012.01) |

(52) U.S. Cl.

CPC ..... *E21B 17/04* (2013.01); *E21B 15/00* (2013.01); *E21B 33/06* (2013.01); *E21B 47/008* (2020.05); *E21B 47/06* (2013.01)

(58) Field of Classification Search

CPC ..... E21B 15/00; E21B 17/04; E21B 33/06; E21B 47/06; E21B 47/0007; E21B 47/008; E21B 47/117

See application file for complete search history.

(56) References Cited

U.S. PATENT DOCUMENTS

| | | | | |
|---|---|---|---|---|
| 4,854,383 | A * | 8/1989 | Arnold | E21B 33/05 166/70 |
| 5,616,208 | A | 4/1997 | Lee | |
| 6,378,627 | B1 | 4/2002 | Tubel et al. | |
| 6,440,030 | B1 | 8/2002 | Minegishi et al. | |
| 7,165,619 | B2 | 1/2007 | Fox et al. | |
| 7,281,582 | B2 | 10/2007 | Robichaux et al. | |
| 8,136,394 | B2 * | 3/2012 | Hsu | G01N 33/2823 73/152.24 |
| 10,018,039 | B2 * | 7/2018 | Zhou | E21B 34/14 |
| 2002/0100585 | A1 * | 8/2002 | Spiers | E21B 49/081 166/264 |
| 2007/0107910 | A1 * | 5/2007 | McGuire | E21B 33/047 166/379 |
| 2010/0193245 | A1 | 8/2010 | Glomsrud et al. | |
| 2014/0027113 | A1 * | 1/2014 | Veeningen | E21B 47/117 166/250.08 |
| 2019/0136659 | A1 * | 5/2019 | Ringgenberg | E21B 33/1246 |
| 2019/0383104 | A1 * | 12/2019 | Pickelsimer | E21B 47/06 |

* cited by examiner

*Primary Examiner* — Daniel P Stephenson

(74) *Attorney, Agent, or Firm* — Hall Estill Attorneys at Law; Tyler Mantooth

(57) ABSTRACT

A drill string can be tested with a system that involves at least a test coupling positioned between and physically connecting an upstream portion of a drill string and a downstream portion of the drill string. The test coupling may have an isolation wall that fluidically separates the upstream portion from the downstream portion. Each drill string portion can be connected to a pressure source that selectively pressurizes and tests the portions of the drill string.

20 Claims, 3 Drawing Sheets

DRILL STRING TESTING SYSTEM

SUMMARY OF THE INVENTION

A drill string testing system, in accordance with some embodiments, has a test coupling positioned between and physically connecting an upstream portion of a drill string and a downstream portion of the drill string. The test coupling has an isolation wall that fluidically separates the upstream portion from the downstream portion. Each drill string portion is connected to a pressure source that selectively pressurizes and tests the portions of the drill string Various embodiments configure a drill string testing system operates by connecting a test coupling physically in contact with and between an upstream portion of a drill string and a downstream portion of the drill string. The test coupling having an isolation wall fluidically separating the upstream and downstream portions. The upstream portion and downstream portion are pressurized with a pressure source connected to the test coupling to test the drill string for a fault.

In other embodiments, a drill string testing system has a test coupling positioned between and physically connecting an upstream portion of a drill string from a downstream portion of the drill string. The test coupling has an isolation wall fluidically separating the test coupling into first and second chambers with the first chamber connected to the upstream portion and the second chamber connected to the downstream portion. Each drill string portion is connected to one or more pressure sources.

DETAILED DESCRIPTION

Various embodiments of the present disclosure are generally directed to a drill string testing system that reduces operational down-time for a hydrocarbon exploration equipment testing.

As hydrocarbon exploration has evolved and become more sophisticated, the value of an hour of operation of a derrick has increased. Such operating hour expense is compounded by even more expensive hours of non-operation. That is, each hour a derrick is not operating is more expensive in terms of well completion time and lost overhead than an hour a derrick is operating. Hence, it is a continued goal of the hydrocarbon drilling industry to minimize drilling component testing operations that mandate a non-operating derrick.

Accordingly, a drill string testing system, in some embodiments, has a test coupling positioned between and physically connecting an upstream portion of a drill string and a downstream portion of the drill string with the test coupling having an isolation wall that fluidically separates the upstream and downstream portions. The test coupling has at least one port communicating with the respective upstream and downstream drill string portions to allow concurrent and independent pressurized testing of the entire drill string. The ability to isolate the respective drill string portions provides reduced overall testing time and increased component failure resolution compared to testing drill string portions individually or all together.

Figure 1:
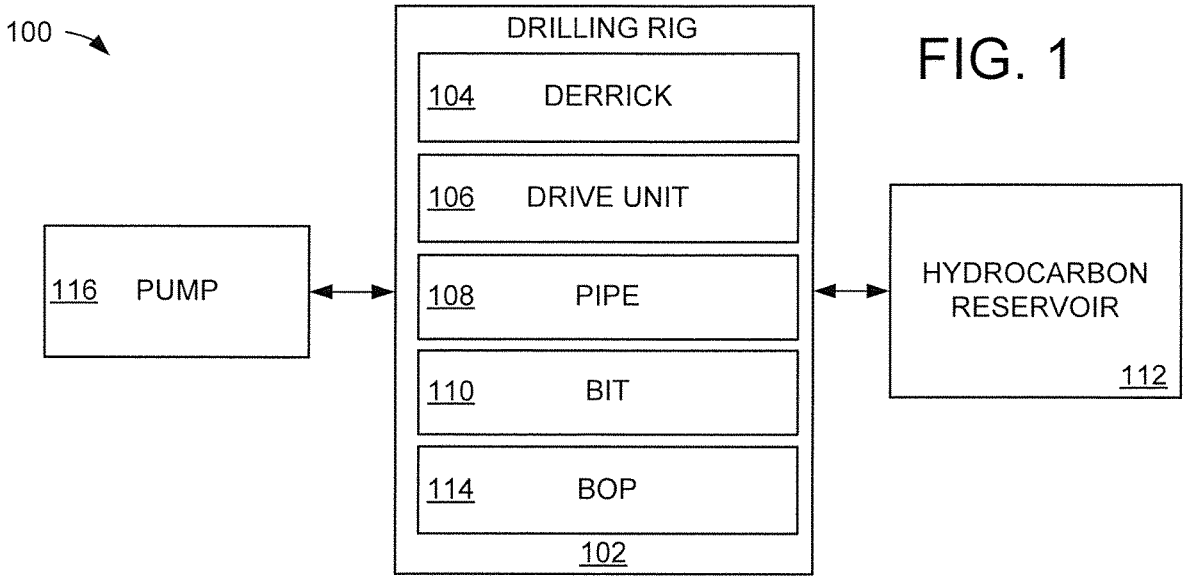
FIG. 1 is a block representation of an example hydrocarbon exploration system arranged in accordance with various embodiments.

FIG. 1 illustrates a block representation of an example hydrocarbon exploration system 100 in which various embodiments of the present disclosure can be practiced. The hydrocarbon exploration system 100 can have one or more drilling rigs 102 the have a derrick 104 positioning a drive unit 106 over a pipe 108 connected to a bit 110. Articulation of the bit 110 and extension of the pipe 108 via the drive unit 106 allows for an exploration bore to be created.

One an exploration bore is at a predetermined depth below ground to engage a hydrocarbon reservoir 112, the bit 110 is removed and the bore is cased to provide a hydrocarbon well capable of producing oil and/or gas containing hydrocarbons. While drilling to the predetermined depth, or after the well is completed, one or more safety components can be utilized along a drill string to allow flow of hydrocarbons to be controlled. For instance, a drill string can have a blow-out preventer (BOP) 114 positioned below ground and various valves positioned at ground level to control the volume of hydrocarbons reaching ground level before intended.

Figure 2A:
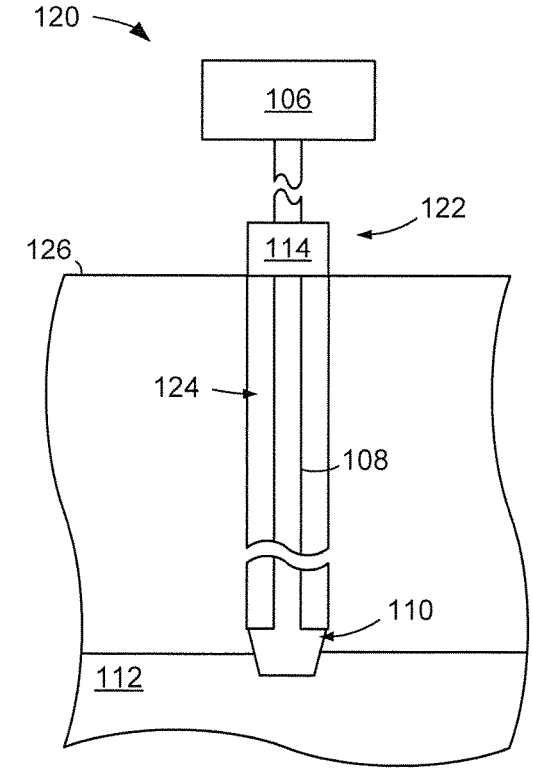
FIGS. 2A & 2B respectively show of portions of an example hydrocarbon exploration system that may be utilized in the system of FIG. 1.
Figure 2B:
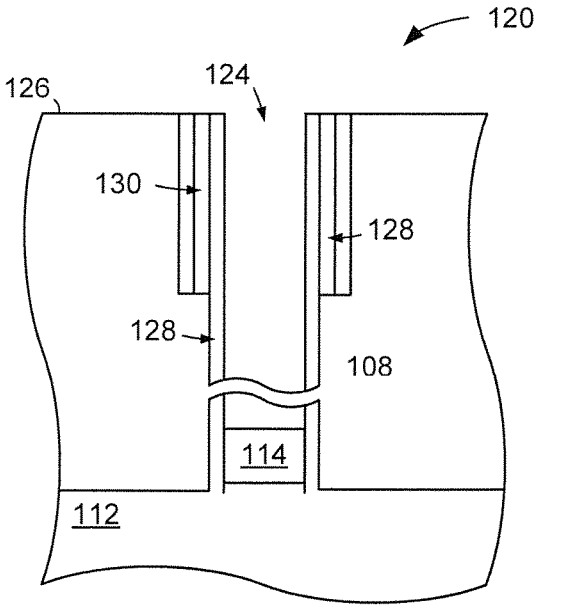

One or more pumps 116 can be connected to the drilling string to move liquids in, and out, of a wellbore. As a non-limiting example, a pump 116 can push mud with a particular viscosity into a wellbore to cool the bit 110 and aid in removing debris. In another example, a pump 116 can provide cement to secure the pipe 108 in the wellbore. FIGS. 2A and 2B respectively depict line representations of portions of a hydrocarbon exploration system 120 arranged in accordance with some embodiments. FIG. 2A shows a downhole portion of a drill string 122 where a bit 110 is creating a wellbore 124 continuously extending from a ground level 126 into a hydrocarbon reservoir 112.

Opposite the bit 110, a drive unit 106 connects to the drill string 122 and selectively spins in the X-Y plane while moving along the Z axis to articulate the drill string 122 relative to the wellbore 124. It is contemplated that a BOP 114 can be positioned anywhere in the drill string 122 between the bit 110 and the drive unit 106. Other embodiments, as shown in FIG. 2B, positions a BOP 114 in place of a bit 110 engaging the hydrocarbon reservoir 112 once portions of the drill string 122 is secured in the wellbore 124 with a casing 128 and at least one layer of cement 130.

The BOP 114 operates to selectively seal the drill string 122 or relieve pressure to prevent an unwanted spike in hydrocarbon pressure and volume in the wellbore 124. While being capable of positioning anywhere along the wellbore 124 at any time during drilling and completion of a well, various embodiments involve testing the drill string 122 with an attached BOP 114 during drilling operations and prior to completion of the well and casing 128 of the drill string 122. Such drill string 122 testing may, or may not, remove portions of the drill string 122 with the drive unit 106 prior to pressurizing the drill string 122 artificially to test the integrity and reliability of the BOP 114 and drill string 122.

Figure 3A:
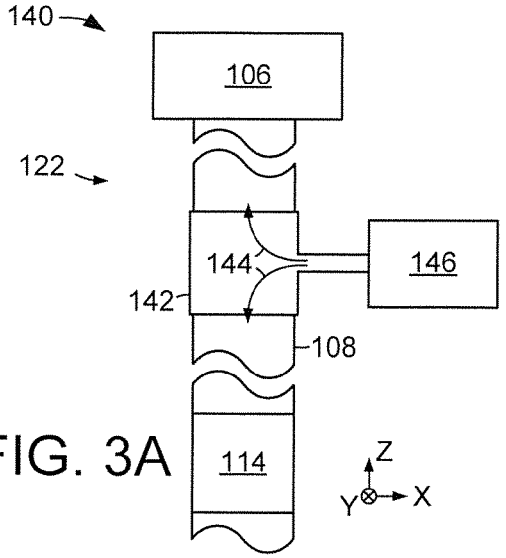
FIGS. 3A & 3B respectively depict portions of an example hydrocarbon exploration system employed as part of the system of FIG. 1.
Figure 3B:
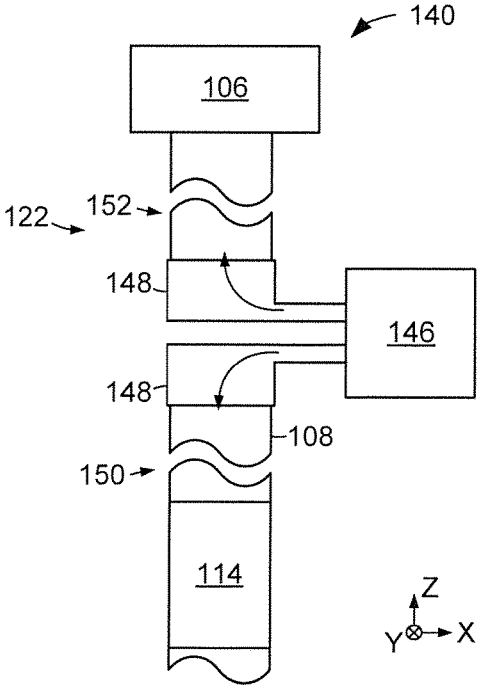

FIGS. 3A and 3B respectively display portions of an example hydrocarbon exploration system 140 configured in accordance with some embodiments. The side view line representation of FIG. 3A illustrates how a drill string 122 can be tested with a single test coupling 142 that is physically integrated into the drill string 122 between a BOP 114 and a drive unit 106. The physical integration of the test coupling 142 may involve securing the coupling 142 to the pipe 108, such as via clamps or threaded connection. It is noted that the drill string 122 may be secured via one or more external clamps prior, during, and/or after securing the test coupling 142.

The cross-sectional representation of the test coupling 142 shows how pressure flow, as illustrated by arrows 144, concurrently flows from one or more pressure sources 146 downstream towards the BOP 114 and upstream towards the drive unit 106 to fill the drill string 122 with a single, uniform pressure. While effective at testing the entire drill string 122, the single test coupling 142 of FIG. 3A can be difficult to utilize to pinpoint the location of a component failure in the drill string 122. For example, a loss of pressure while pressurizing the single test coupling 142 will indicate a leak in the drill string 122, but cannot indicate if the leak is in the downstream portion (towards the BOP 114) or upstream (towards the drive unit 106).

FIG. 3B displays an alternate test coupling 148 that can isolate a pressure leak during testing. As shown, the alternate test coupling 148 can secure to either the downstream portion 150 or upstream portion 152 of the drill string 122 to provide pressure that tests the integrity of a single respective drill string portion 150/152 at a time. However, the increase in testing resolution provided by the alternate test coupling 148 corresponds with slower overall drill string 122 testing due to the labor involved with securing the coupling 148, pressurizing the portion 150/152, depressurizing, removing the coupling 148, installing the coupling 148 on the other portion, testing the other portion, and removing the coupling 148 from the drill string 122.

Figure 4:
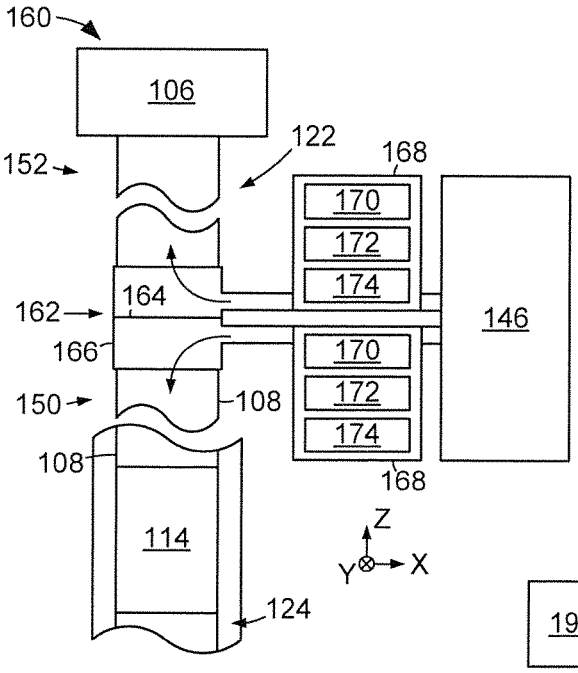
FIG. 4 conveys portions of an example drill string testing system configured and operated in accordance with assorted embodiments.

In addition, the suspension of the drive unit 106 unconnected to the downstream portion 150 can be a safety hazard, particularly when the upstream portion 152 is under pressure during testing. With the testing resolution and overall testing time of drill string 122 at a premium, various embodiments are directed to a testing system that provides an optimized balance between testing resolution and overall testing time. FIG. 4 depicts an example drill string testing system 160 constructed and operated to optimize testing of a drill string 122 resident in a hydrocarbon exploration wellbore 124. The testing system 160 consists of a single test coupling 162 that physically secures concurrently to the downstream 150 and upstream 152 portions of the drill string 122.

In contrast to the test coupling 142, test coupling 162 has an isolation wall 164 that fluidically separates the upstream 152 and downstream 150 portions of the drill string 122. Although the fluidic separation can be accomplished with two physically separate couplings that are physically attached, such as via a fastener, clamp, or strap, the physical integrity of the drill string 122 would be in jeopardy as the physical attachment would be the weakest aspect of the drill string 122 under high pressure, such as 10,000 psi or more. Accordingly, constructing a single test coupling 162 with an isolation wall 164 maintains the integrity of the overall drill string 122 due to the unitary coupling body 166 continuously extending between, and contacting the respective string portions 150/152.

By utilizing the separated chambers of a single test coupling 162, the drive unit 106 can be continuously attached to the downstream drill string portion 150 during testing, which improves overall testing safety. The concurrent pressurization of the upstream 152 and downstream 150 drill string portions with the single test coupling 162 further improves the efficiency of testing as the entire drill string 122 can be tested as once. The ability to independently pressurize, depressurize, and adjust pressurization in the different portions 150/152 of the drill string 122 allows for relatively high testing resolution as the source of leaks can more easily be isolated to a particular component than if the drill string 122 was pressurized with a single test pressure, as shown in FIG. 3A.

In some embodiments, each isolated chamber of the test coupling 162 is fluidically connected to one or more pressure sources 146 via a control module 168 that provides computing capability to execute a testing procedure, analyze test data, and report testing results. Although not required or limiting, the control module 168 may be any computing device, such as a smartphone, laptop, tablet, or dedicated remote, that consists of a controller 170, such as a microprocessor and/or application specific integrated circuit, a local data memory 172, such as non-volatile solid state memory or magnetic rotating media, and a graphical interface 174, such as a touchscreen.

While a single control module 168 may be connected to, and execute independent testing operations on, each portion 150/152 of the drill string 122, various embodiments arrange at least two separate control modules 168, as shown, to respectively contact and control testing of either the downstream 150 or upstream 152 portions of the drill string 122. It is contemplated that the respective control modules 168 can conduct matching, or different test procedures concurrently, or consecutively, to test the integrity of the drill string 122 and, if needed, identify the component(s) where a pressure leak is present.

Figure 5:
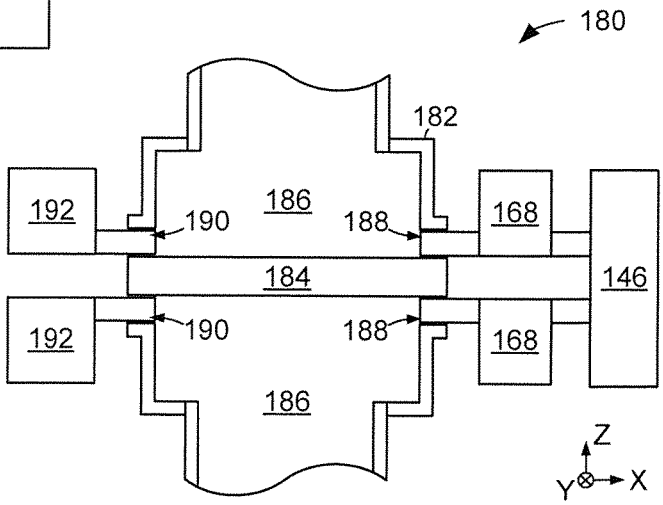
FIG. 5 illustrates a line representation of portions of an example drill string testing system arranged in accordance with various embodiments.

The test coupling 162 may have one or more additional fluid ports that may, or may not be connected to, and controlled by, a control module 168. FIG. 5 is a line representation of portions of an example drill string test system 180 that can be employed in the hydrocarbon exploration systems of FIGS. 1-2B in some embodiments. The test system 180 has a single test coupling 182 that incorporates one or more isolation walls 184 to create two fluidically separate chambers 186 within the coupling 182. The separate chambers 186 can respectively communicate with the downstream 150 or upstream 152 portions of a drill string 122, as previously discussed.

Each chamber 186 can also communicate with one or more pressure sources 146 via a first port 188 and with other pressure control equipment 192 via a second port 190. It is noted that one or more of the ports 188/190 may be accessed via a valve, such as a ball valve, check valve, or electronic solenoid, that is integrated into the test coupling 182. Some embodiments connect a second port 190 of at least one chamber 186 to a standpipe and/or fluid pump. Connection to a standpipe allows additional tests to be conducted via the test coupling 182 concurrently with a high pressure test. The ability to concurrently conduct multiple tests via the test coupling 182 can reduce overall testing hours, which equates to less man hours being occupied and less safety liability.

In other embodiments, a second port 190 is connected to one or more valves that can reduce, increase, and otherwise manipulate pressure portions of the drill string 122. Such pressure control ability, along with the control module 168 control of the pressure source, provides heightened safety and pressure testing reliability for a diverse variety of static, and dynamic, testing conditions, such as temperature, humidity, and drill string vibration.

Figure 6:
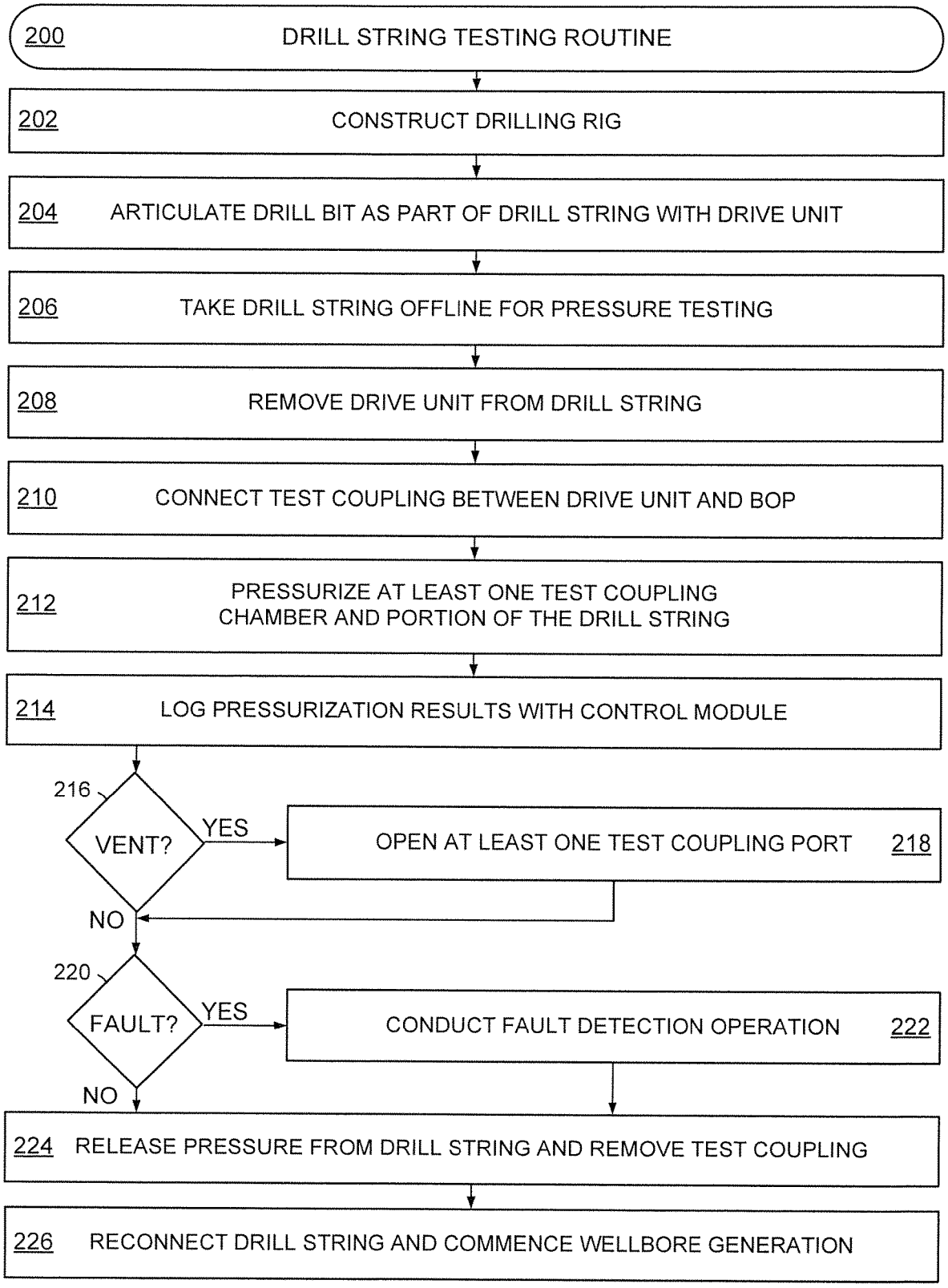
FIG. 6 provides a flowchart of an example drill string testing routine that can be carried out by the assorted embodiments of FIGS. 1-5.

FIG. 6 provides a flowchart of an example drill string testing routine 200 that can be carried out with the various embodiments of FIGS. 1-5 in accordance with assorted embodiments. Initially, a drilling rig is constructed in step 202 with at least a drive unit articulating a drill bit as part of a drill string that is used in step 204 to create a wellbore. It is contemplated that the drill string in step 204 involves at least one BOP connected between the drive unit and the drill bit.

At any time before and during step 204, the drill string is taken offline in step 206 for pressure testing. It is noted that taking the drill string offline is considered not creating any new wellbore depth with the drill bit. Step 208 proceeds to remove the drive unit from the drill string so that a test coupling can be physically connected in step 210 between the drive unit and the BOP and drill bit. The physical structure of the test coupling with an isolation wall creating two fluidically independent chambers results in step 210 providing independent upstream and downstream portions of the drill string.

With the test coupling connected to at least one pressure source to supply greater than atmospheric pressure/vacuum to the upstream and downstream portions of the drill string, step 212 selectively pressurizes at least one chamber of the test coupling and at least one portion of the drill string to a test pressure, such as 10,000 psi. It is contemplated that step 212 executes a pattern of various different pressures over time, which may involve negative (vacuum) pressure, as directed by a testing control module.

The results of the testing in step 212 are logged by at least one control module in step 214 to evaluate if a weakness, or failure, is present in the drill string. A weakness is defined as a functioning component that is operates with a degraded safety margin and/or hydrocarbon exploration performance. For instance, a weakness detected in steps 212 and 214 can be plastic deformation of metal in a valve, pipe, solenoid, or other drill string component that provides a sealed drill string, but with characteristics that increase the risk of failure and/or the capability of the component to perform its intended function.

Decision 216 follows step 212 and evaluates if portions of the drill string are to be vented, such as to a standpipe or other valved connections. If venting is chosen in decision 216, step 218 then opens at least one valved port in the test coupling to change the pressure in one or more portions of the drill string. It is contemplated that the venting of step 218 is conducted independently or as part of a testing process where variable pressure is applied to the drill string. For example, decision 220 can evaluate if a drill string fault is present in the measurements of step 212 and choose to conduct pressure venting via decision 216 as part of an overall fault detection procedure.

Decision 220 may alternatively conduct fault detection with step 222 providing uniform and/or varying pressure to one, or both, portions of the drill string to identify the location of a fault. As a non-limiting example, step 222 may close one or more valves, change pressure, and hold pressure over time to isolate the location of a detected drill string fault to a particular component, such as the BOP or section of drill pipe. It is noted that a control module may direct the fault detection operation in accordance with previously logged conditions, such as mud volume, mud pressure, mud viscosity, ambient humidity, downhole temperature, drill bit age, and wellbore depth, as measured by one or more sensors connected to the control module.

If no drill string fault is found in decision 220, or at the conclusion of step 222 where one or more fault detection operations are carried out to identify at least one faulty drill string component, such as a particular pipe joint, drive unit, bop, or valve, step 224 returns the drill string to ambient pressure and removes the test coupling. Reconnection of the upstream and downstream portions of the drill string in step 226 allows wellbore generation, and hydrocarbon extraction, to continue until the drill string is to be tested again, at which point routine 200 returns to step 206.

Through the various embodiments of this disclosure, testing of a drill string can be optimized to be safer, faster, and more precise than previous testing systems. The ability to intelligently pressurize a drill string while the drill string is rigidly connected via a single test coupling provides safety during testing. The bifurcation of a single test coupling into fluidically independent chambers allows for individual, and concurrent, pressurization and testing of different portions of a drill string, which decreases the overall pressure testing and drilling certification time.

What is claimed is:

1. An apparatus comprising a test coupling positioned between and physically connecting an upstream portion of a drill string and a downstream portion of the drill string, a control module connected between the test coupling and a pressure source, the test coupling comprising an isolation wall fluidically separating the upstream and downstream portions, each drill string portion connected to the pressure source and tested for a fault by the control module.

2. The apparatus of claim 1, wherein the upstream portion comprises a drive unit.

3. The apparatus of claim 1, wherein the downstream portion comprises a blowout preventer.

4. The apparatus of claim 1, wherein the downstream portion comprises a drill bit.

5. The apparatus of claim 1, wherein the test coupling concurrently attaches to a first pipe of the downstream portion and a second pipe of the upstream portion.

6. A system comprising a test coupling positioned between and physically connecting an upstream portion of a drill string and a downstream portion of the drill string, at least one control module connected between the test coupling and a first pressure source the test coupling comprising an isolation wall fluidically separating the test coupling into first and second chambers, the first chamber connected to the upstream portion, the second chamber connected to the downstream portion, each drill string portion connected to at least the first pressure source and a second pressure source and tested for a fault by the at least one control module.

7. The system of claim 6, wherein the first and second chambers are respectively connected to the first and second pressure sources via the at least one control module.

8. The system of claim 7, wherein the at least one control module comprises a controller interacting with a local data memory.

9. The system of claim 6, wherein the downstream portion is located within a wellbore and the upstream portion is located outside of the wellbore, above a ground level.

10. The system of claim 6, wherein the first chamber has a first port connected to the first pressure source and the second chamber has a second port connected to the second pressure source.

11. The system of claim 6, wherein each chamber has a first port respectively connected to the first and second pressure sources and a second port connected to a pressure control equipment.

12. The system of claim 6, wherein the test coupling comprises a unitary body housing each chamber.

13. The system of claim 12, wherein the isolation wall spans the unitary body to seal and separate each chamber.

14. A method comprising:

connecting a test coupling physically in contact with and between an upstream portion of a drill string and a downstream portion of the drill string, the test coupling comprising an isolation wall fluidically separating the upstream and downstream portions;

pressurizing the upstream portion and downstream portion with a pressure source connected to the test coupling; and testing the drill string for a fault.

15. The method of claim 14, wherein the testing comprises pressurizing at least one of the upstream portion or downstream portion to 10,000 psi or more.

16. The method of claim 14, wherein the fault is detected by a control module connected between the test coupling and the pressure source.

17. The method of claim 16, wherein the control module adjusts the pressure in the downstream portion to identify a component where the fault is present.

18. The method of claim 16, wherein the control module triggers a vent port of the test coupling to open to decrease a testing pressure in the upstream portion.

19. The method of claim 16, wherein the control module logs at least one result of the testing step to identify the fault.

20. The method of claim 14, wherein the upstream portion and downstream portion are concurrently pressurized by the pressure source.

* * * * *